US008286444B2

(12) United States Patent
Sasaki et al.

(10) Patent No.: US 8,286,444 B2
(45) Date of Patent: Oct. 16, 2012

(54) DISPENSER

(75) Inventors: Makoto Sasaki, Aichi (JP); Kouichi Itou, Aichi (JP); Yuji Hirano, Aichi (JP); Motohiro Kawachi, Aichi (JP); Hiroshi Nagai, Aichi (JP)

(73) Assignee: Hoshizaki Denki Kabushiki Kaisha, Aichi-ken (JP)

( * ) Notice: Subject to any disclaimer, the term of this patent is extended or adjusted under 35 U.S.C. 154(b) by 525 days.

(21) Appl. No.: 12/629,311

(22) Filed: Dec. 2, 2009

(65) Prior Publication Data

US 2010/0140296 A1 Jun. 10, 2010

(30) Foreign Application Priority Data

Dec. 4, 2008 (JP) ..... 2008-310267

(51) Int. Cl.
*F25C 1/14* (2006.01)

(52) U.S. Cl. ..... 62/354

(58) Field of Classification Search ..... 62/340, 62/354; 222/108, 146.6, 148, 149
See application file for complete search history.

(56) References Cited

U.S. PATENT DOCUMENTS 4,848,381 A 7/1989 Livingston et al.
4,860,550 A * 8/1989 Aoki et al. ..... 62/135
5,018,363 A * 5/1991 Aoki et al. ..... 62/135
7,896,198 B2 * 3/2011 Mehus et al. ..... 222/77

FOREIGN PATENT DOCUMENTS

EP 0 287 194 10/1988
JP 63-063887 4/1988

OTHER PUBLICATIONS

European Search Report (in English language) issued Apr. 30, 2010 in corresponding European Patent Application No. 09014758.

* cited by examiner

*Primary Examiner* — Melvin Jones
(74) *Attorney, Agent, or Firm* — Wenderoth, Lind & Ponack, LLP

(57) ABSTRACT

Provided is a dispenser in which a wash water discharge opening provided to a drain pan is connected to an external tap water system via a wash water supply path. The wash water supply path is provided with a wash water supply valve for controlling whether or not to supply wash water to the drain pan. Based on delivery information output from a delivery control section for controlling delivery of ice chips, a wash control section in a controller judges whether or not a delivery count of the ice chips has reached a predetermined set count, and, when it is judged that the delivery count has reached the set count, opens the wash water supply valve to perform a wash action.

5 Claims, 11 Drawing Sheets

DISPENSER

BACKGROUND OF THE INVENTION

1. Field of the Invention

The present invention relates to a dispenser for delivering a supply from a delivery opening.

2. Description of the Related Art

In general, examples of the conventionally-used dispensers of such kind include a drink dispenser and an ice chip dispenser. The drink dispenser delivers such drinks as water, juice, and soup in response to an operation performed by a user. As a configuration of the drink dispenser, a configuration in which only drinks are delivered or a configuration in which ice chips are delivered together with drinks may be employed. The ice chip dispenser delivers ice chips in response to the operation performed by the user.

In some cases, such dispensers are used for drink bars in, for example, family restaurants and manga (comic book) cafes. The drink bar offers such service that allows users to freely operate a dispenser set up in a drink bar area of a restaurant or a shop in advance so that the users can freely select drinks that they want. For such a drink bar, in some cases, a drink dispenser having a configuration in which ice chips can be supplied together with drinks is set up alone. In other cases, a drink dispenser having a configuration in which only drinks are delivered is set up along with an ice chip dispenser.

When a dispenser is used for a drink bar, there occurs a case in which leftover juice or soup is thrown away into a drain pan of the dispenser. If juice and the like including juice and soup are thrown away into the drain pan, the juice and the like go dry, and may adhere to the drain pan. In order to prevent the dried juice and the like from adhering to the drain pan, wash water or the like may be supplied to the drain pan.

An example of the configuration that enables the wash water to be supplied to the drain pan includes an apparatus described in Japanese Utility Model Application Laid open No. S63-63887. Specifically, in a conventional dispenser, an ice-making water tank of a plate-type ice-making machine is connected to a drain pan by means of piping. Every time a deicing cycle of the plate-type ice-making machine is started, ice-making water stored in the ice-making water tank is supplied to the drain pan as the wash water. The deicing cycle is included in an ice-making action performed by the plate-type ice-making machine. In this cycle, the ice-making water is sprayed onto the back side of an ice-making plate, to thereby remove from the ice-making plate an ice plate formed on the front side of the ice-making plate.

With such a conventional dispenser as described above, in which the wash water is supplied to the drain pan every time the deicing cycle is started, it is impossible to make a detailed response suitable to the usage of the dispenser, and hence this may lead to insufficient washing. Specifically, depending on the installation environment of the dispenser, the deicing cycle may not be performed all day long even though the dispenser is used, and, as a result, dried juice and the like may adhere to the drain pan.

SUMMARY OF THE INVENTION

In order to solve the above-mentioned problem, the present invention has been made, and it is therefore an object of the present invention to provide a dispenser capable of carrying out washing with a response appropriate to the usage of a dispenser to more appropriately prevent dried juice and the like from adhering to a drain pan.

According to the present invention, there is provided a dispenser that delivers ice chips from a delivery opening, and that has a drain pan disposed below the delivery opening so that the ice chips are received. The dispenser includes: a delivery control section for controlling delivery of the ice chips; a wash water discharge opening provided to the drain pan; a wash water supply path connected to the wash water discharge opening; a wash water supply valve provided to the wash water supply path; and a wash control section connected to the wash water supply valve, for performing, by opening the wash water supply valve, a wash action of supplying wash water to the drain pan through the wash water supply path and the wash water discharge opening. The wash control section judges, based on information from the delivery control section, whether or not a delivery count of the ice chips has reached a predetermined set count, and, when it is judged that the delivery count has reached the predetermined set count, performs the wash action.

Further, there is provided a dispenser that delivers ice chips from a delivery opening, and that has a drain pan disposed below the delivery opening so that the ice chips are received. The dispenser includes: a generation control section for controlling generation of the ice chips; a water supply main valve connected to the generation control section, for performing, in response to the controlling from the generation control section, switching as to whether or not to supply an ice-making water tank with ice-making water to be used for the generation of the ice chips; a wash water discharge opening provided to the drain pan; a wash water supply path connected to the wash water discharge opening; a wash water supply valve provided to the wash water supply path; and a wash control section connected to the wash water supply valve, for performing, by opening the wash water supply valve, a wash action of supplying wash water to the drain pan through the wash water supply path and the wash water discharge opening. The wash control section judges, based on information from the generation control section, whether or not a count of valve openings of the water supply main valve has reached a predetermined set count, and, when it is judged that the count of the valve openings has reached the predetermined set count, performs the wash action.

DETAILED DESCRIPTION OF THE PREFERRED EMBODIMENTS

Hereinbelow, embodiments for accomplishing the present invention are described with reference to the attached drawings.

First Embodiment

Figure 1:
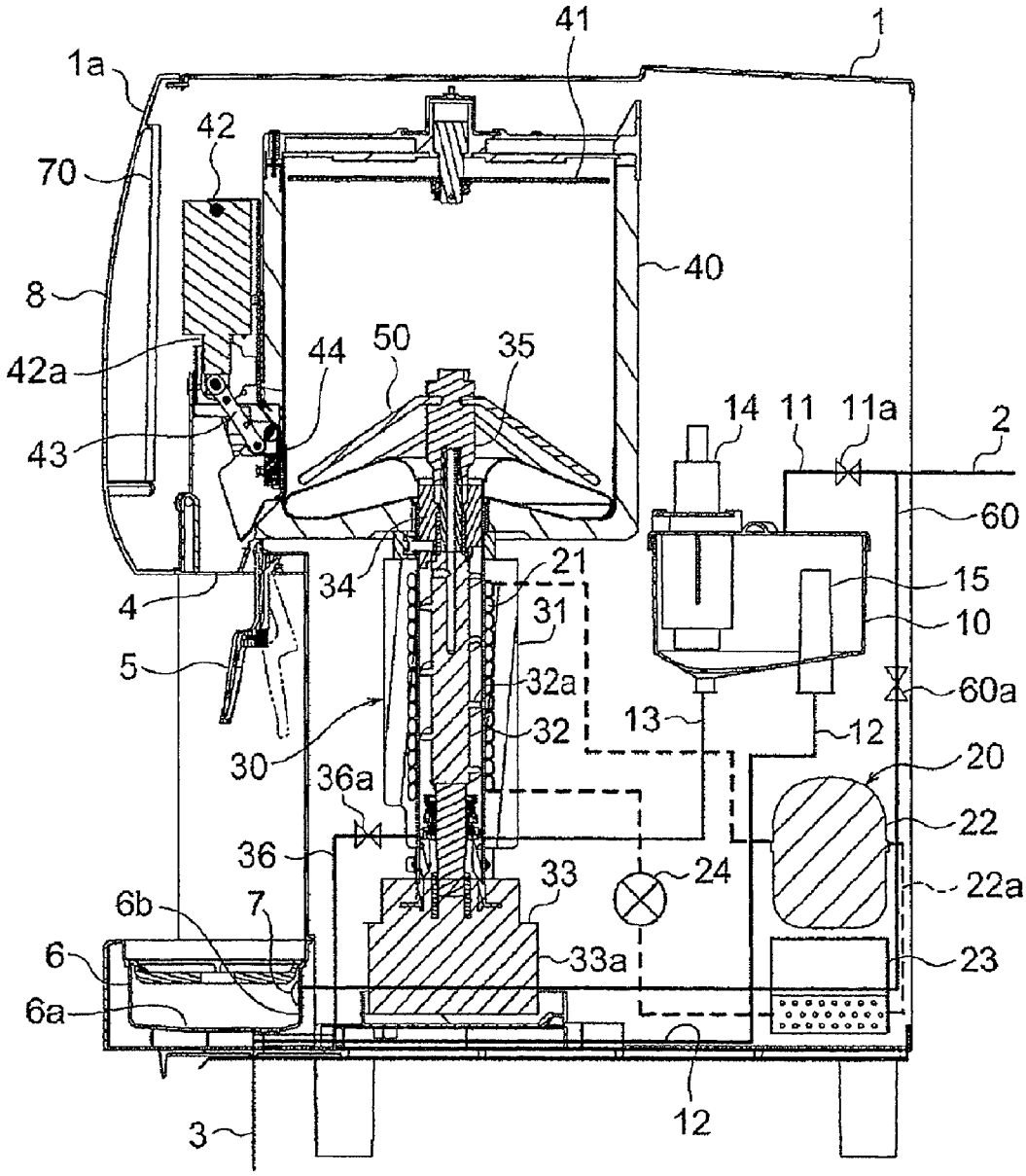
FIG. 1 is a sectional view of an ice chip dispenser according to a first embodiment of the present invention.
Figure 2:
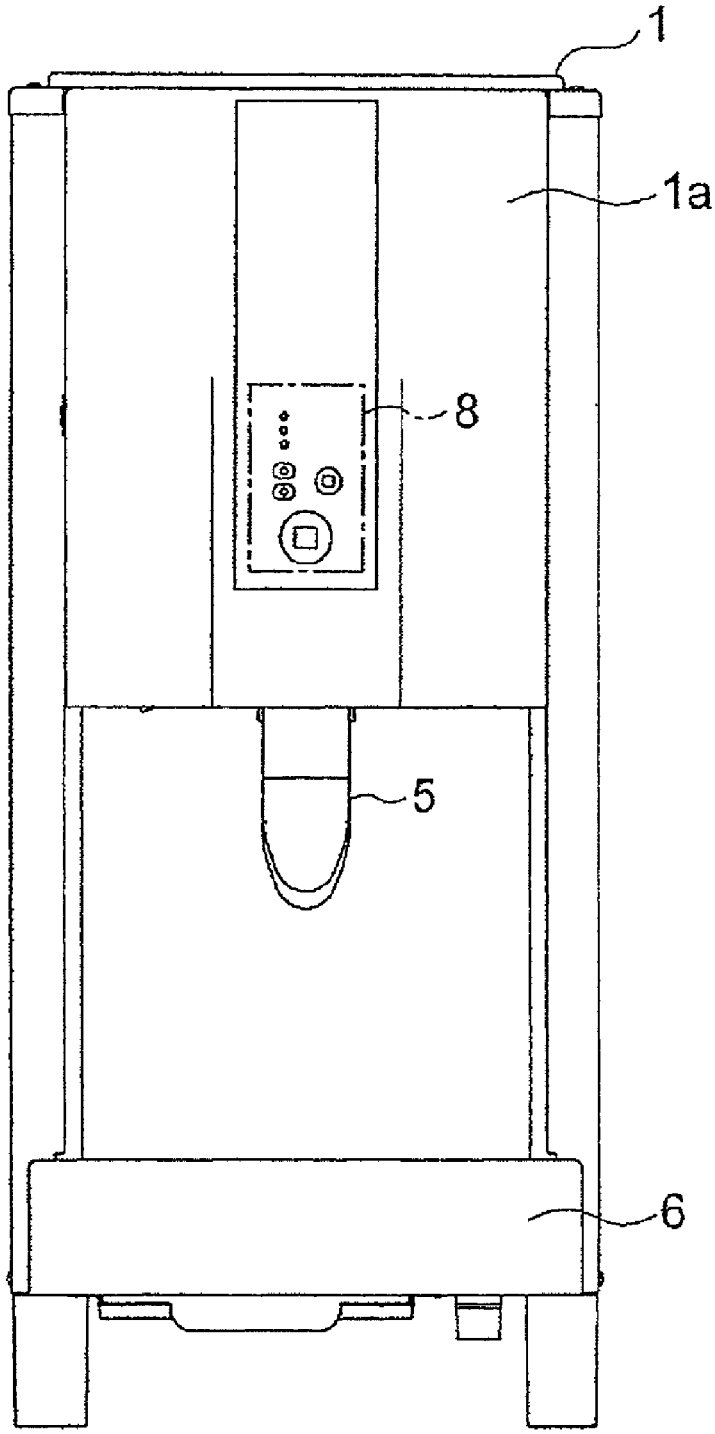
FIG. 2 is a front view of the ice chip dispenser of FIG. 1.

FIG. 1 is a sectional view of an ice chip dispenser according to a first embodiment of the present invention. FIG. 2 is a front view of the ice chip dispenser of FIG. 1. In FIG. 1, inside an casing 1, there are housed an ice-making water tank 10, a refrigeration circuit 20, an auger ice-making machine 30, an ice storage chamber 40, an agitator 50, a wash water supply path 60, and control means 70.

To the ice-making water tank 10, a water supply main tube 11, an overflow drain tube 12, and an ice-making water supply tube 13 are connected. Further, the ice-making water tank 10 is provided with a float sensor 14 and an overflow pipe 15. A top portion of the ice-making water tank 10 is connected to an external tap water system 2 via the water supply main tube 11. The water supply main tube 11 is provided with a water supply main valve 11*a* for controlling whether or not to supply ice-making water to the ice-making water tank 10. Specifically, when the water supply main valve 11*a* is opened, tap water is supplied as ice-making water from the external tap water system 2 to the ice-making water tank 10.

The float sensor 14 includes a float (not shown) that floats in the ice-making water stored in the ice-making water tank 10, and is used for detecting a water level of the ice-making water stored in the ice-making water tank 10. Specifically, the float sensor 14 detects whether or not the water level of the ice-making water has reached a predetermined upper-limit water level, and also detects whether or not the water level of the ice-making water has reached a predetermined lower-limit water level. The float sensor 14 inputs an output signal to the control means 70. The control means 70 controls the closing and opening of the water supply main valve 11*a* based on the output signal from the float sensor 14, and details thereof are described later.

The overflow pipe 15 is installed into the ice-making water tank 10 such that the upper end thereof is positioned above the upper-limit water level. Specifically, when the water level of the ice-making water is above the upper-limit water level, the overflow pipe 15 serves to exhaust the ice-making water out of the ice-making water tank 10 by the amount exceeding the upper-limit water level. The lower end of the overflow pipe 15 is connected to an external drain system 3 via the overflow drain tube 12. The ice-making water exhausted from the overflow pipe 15 flows through the overflow drain tube 12, and is then exhausted into the external drain system 3.

The ice-making water supply tube 13 connects a lower portion of the ice-making water tank 10 and the auger ice-making machine 30. The ice-making water supply tube 13 supplies the ice-making water stored in the ice-making water tank 10 to the auger ice-making machine 30.

The refrigeration circuit 20 is provided with a cooling pipe 21, a compressor 22, a condenser 23, and an expansion valve 24. The cooling pipe 21 is integrated onto the auger ice-making machine 30, and description thereof is given later. A refrigerant flows through the cooling pipe 21, and vaporization of the refrigerant causes the ice-making water of the auger ice-making machine 30 to be cooled. In other words, the cooling pipe 21 serves as an evaporator of the refrigeration circuit 20. The compressor 22 is connected to the cooling pipe 21, and compresses the refrigerant vaporized in the cooling pipe 21. The compressor 22 is connected to the condenser 23 via a high-temperature refrigerant passage 22*a*. Through the high-temperature refrigerant passage 22*a*, there passes the refrigerant with high temperature. The condenser 23 cools, through air cooling or water cooling, the refrigerant that has been compressed by the compressor 22 to thereby condense (liquefy) the refrigerant. The expansion valve 24 is connected to the condenser 23, and decompresses the refrigerant that has been condensed by the condenser 23.

The auger ice-making machine 30 is provided with a refrigeration casing 31, an auger 32, driving means 33, a stationary blade 34, and a cutter body 35.

The refrigeration casing 31 is provided generally in a cylindrical shape. The cooling pipe 21 of the refrigeration circuit 20 is embedded into the refrigeration casing 31.

The auger 32 is a longitudinal member inserted into the refrigeration casing 31, and is rotatably supported by a pair of bearings disposed at the upper and lower portions of the refrigeration casing 31. On the periphery surface of the auger 32, there is provided a helical blade 32*a* along the axial direction of the auger 32.

The driving means 33 is a geared motor connected to the auger 32, and rotationally drives the auger 32. It should be noted that, though the driving means 33 includes a gear portion 33*a* and a motor portion, only the gear portion 33*a* provided at the lower portion of the auger 32 is illustrated in a simplified manner in FIG. 1.

The stationary blade 34 is fixed at the upper portion of the refrigeration casing 31. Detailed description thereof is herein omitted, but the stationary blade 34 is provided with an insertion hole into which the upper end portion of the auger 32 is inserted and a plurality of ice compression passages extending along the axial direction of the auger 32.

The upper end portion of the auger 32 is located within the ice storage chamber 40. The upper end portion of the auger 32 is tapped, and the cutter body 35 is screwed on thereinto. The cutter body 35 is disposed so as to overlap at least part of an area of each of the ice compression passages when viewed along the axial direction of the auger 32.

To the lower portion of the refrigeration casing 31, the ice-making water supply tube 13 from the ice-making water tank 10 and an ice-making water exhaust pipe 36 are connected. The ice-making water exhaust pipe 36 connects the lower portion of the refrigeration casing 31 and the external drain system 3. The ice-making water exhaust pipe 36 is provided with an ice-making water exhaust valve 36*a* for controlling whether or not to exhaust the ice-making water. Specifically, in a state in which the ice-making water exhaust valve 36*a* is closed, the ice-making water is supplied into the refrigeration casing 31 until the water level of the refrigeration casing 31 becomes as high as the water level of the ice-making water stored in the ice-making water tank 10. On the other hand, in a state in which the ice-making water exhaust valve 36*a* is opened, the ice-making water stored in the refrigeration casing 31 is exhausted to the external drain system 3 along with the ice-making water stored in the ice-making water tank 10.

When the refrigerant is caused to pass through the cooling pipe 21 in a state in which the ice-making water is stored in the refrigeration casing 31, the ice-making water is cooled by the refrigerant. As a result, ice is formed on the inner wall of the refrigeration casing 31. The ice formed on the inner wall is scraped off by the helical blade 32*a* of the rotationally-driven auger 32, and then conveyed upward. The ice conveyed upward is compressed in the ice compression passage, and then delivered from the upper portion of the stationary blade 34 as a piece of ice in a column shape. The piece of ice in a column shape, which has been delivered from the upper portion of the stationary blade 34, is further delivered upward to come into contact with the lower portion of the cutter body 35, and then cut in a predetermined length. Pieces of the ice cut in the predetermined length are stored in the ice storage chamber 40 as ice chips.

Inside the ice storage chamber 40, there is disposed the agitator 50 including a plurality of bars secured to the upper portion of the cutter body 35. The agitator 50, which is rotationally driven along with the auger 32, agitates the ice chips stored in the ice storage chamber 40. The upper portion of the ice storage chamber 40 is provided with an ice storage sensor 41 for detecting whether or not the amount of ice chips stored in the ice storage chamber 40 has reached a full ice capacity.

On an upper sidewall of the ice storage chamber 40, there is attached a solenoid actuator 42. To a plunger 42*a* of the solenoid actuator 42, a shutter 44 in a plate shape is connected via a linkage 43. The shutter 44 closes or opens an ice discharge opening provided in a lower sidewall of the ice storage chamber 40. Specifically, in a state in which the plunger 42*a* is projected downward as in FIG. 1, the shutter 44 is pressed against the sidewall of the ice storage chamber 40 in such a manner as to cover the ice discharge opening. On the other hand, when the plunger 42*a* is displaced upward, the upward displacement of the plunger 42*a* causes the shutter 44 to be displaced upward while distancing the shutter 44 from the sidewall of the ice storage chamber 40.

At the front of the casing 1, there is provided a delivery opening 4 that communicates with the ice discharge opening of the ice storage chamber 40 and has an opening in a downward direction. Further, as illustrated in FIGS. 1 and 2, at the front of the casing 1, there is attached a lever 5 for a user to operate. The lever 5 is incorporated with an electromagnetic switch for detecting rotation of the lever 5 (not shown). When the lever 5 is rotated by the user pressing a cup against the lever 5, for example, the control means 70 performs drive control on the solenoid actuator 42 so that the ice discharge opening is opened. When the ice discharge opening is opened, the ice chips stored in the ice storage chamber 40 are delivered out of the casing 1 through the delivery opening 4.

As illustrated in FIGS. 1 and 2, a drain pan 6 is disposed below the delivery opening 4. Specifically, ice chips that the user fails to receive or the like can be received by the drain pan 6. The external drain system 3 is connected to a bottom 6*a* of the drain pan 6. Specifically, water generated from melting ice chips can be exhausted into the external drain system 3.

Here, in a case where the ice chip dispenser according to this embodiment is used for a drink bar in a family restaurant or the like, for example, a drink dispenser for delivering such drinks as water, juice, and soup may be provided as well near the ice chip dispenser. For example, when users want to switch their drinks to other drinks, the users may throw the juices including juices and soups away into the drain pan 6 of the ice chip dispenser.

In a sidewall 6*b* vertically provided at the bottom 6*a* of the drain pan 6, there is provided a wash water discharge opening 7. The external tap water system 2 is connected to the wash water discharge opening 7 via the wash water supply path 60. Specifically, the wash water supply path 60 supplies tap water from the external tap water system 2 to the drain pan 6 as wash water. Further, the wash water supply path 60 is disposed along the high-temperature refrigerant passage 22*a* provided between the compressor 22 and the condenser 23. Specifically, the wash water supply path 60 is in contact with the high-temperature refrigerant passage 22*a*, and hence the wash water within the wash water supply path 60 exchanges heat with the refrigerant of the high-temperature refrigerant passage 22*a*. Therefore, the drain pan 6 is supplied with the wash water that has exchanged heat with the refrigerant.

Further, the wash water supply path 60 is connected to the external tap water system 2 at upstream of the water supply main valve 11*a*. Specifically, the wash water supply path 60 can be supplied with the wash water regardless of the closing and opening of the water supply main valve 11*a*. Further, the wash water supply path 60 is provided with a wash water supply valve 60*a* for controlling whether or not to supply the wash water to the drain pan 6. The wash water supply valve 60*a* is located upstream of a place where the wash water supply path 60 is in contact with the high-temperature refrigerant passage 22*a*. With this configuration, deterioration of the wash water supply valve 60*a* can be reduced by avoiding a state in which the wash water supply valve 60*a* is in contact with the heat of the wash water after the heat exchange.

The control means 70 is attached to the back side of a front panel 1*a* of the casing 1. Further, as illustrated in FIG. 2, on the front side of the front panel 1*a*, there is provided an operation unit 8 including switches for the user to operate. The operation unit 8 is used for inputting a predetermined signal to the control means 70. It should be noted that, though detailed description is not given, the front panel 1*a* forms a door member as is commonly known. The control means 70 is configured by a computer including storage units (RAM and ROM) for storing information such as programs and an arithmetic processing unit (CPU) for performing arithmetic processing, or by a relay circuit. Based on input signals, the control means 70 controls actions of the ice-making water exhaust valve 36*a*, the water supply main valve 11*a*, the refrigeration circuit 20, the driving means 33, the solenoid actuator 42, and the wash water supply valve 60*a*, and description thereof is given later.

Figure 3:
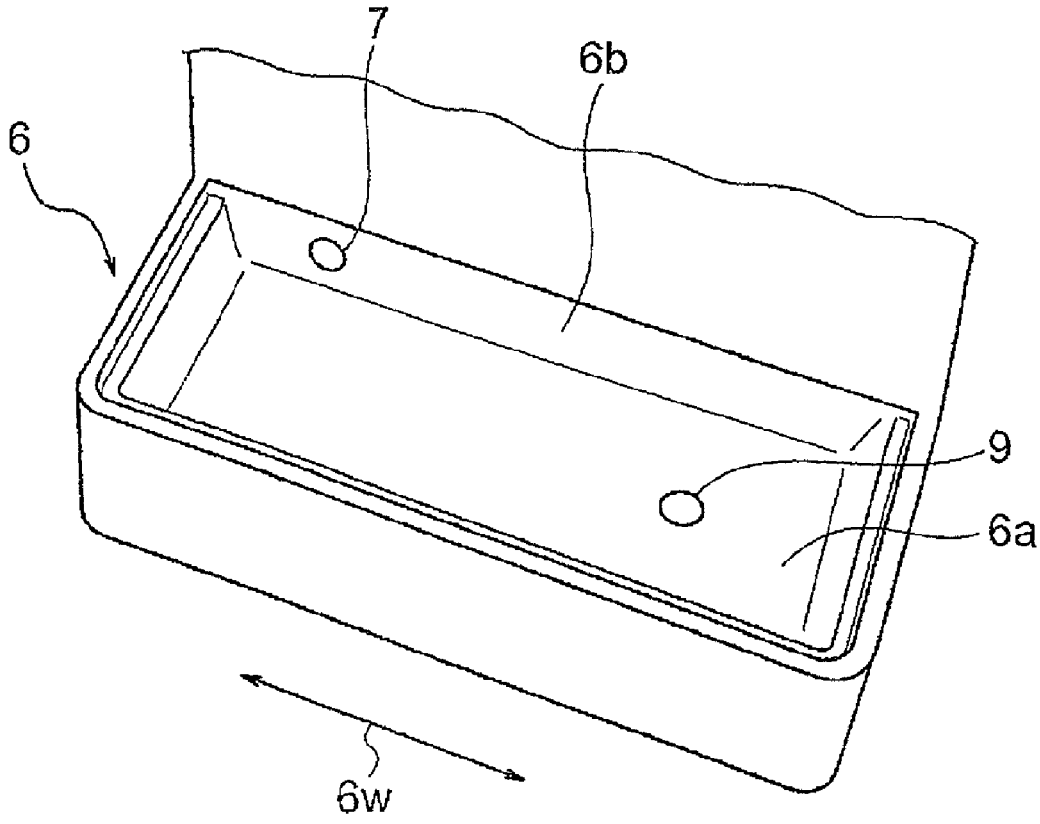
FIG. 3 is a perspective view illustrating a drain pan of FIG. 1.

Next, FIG. 3 is a perspective view illustrating the drain pan 6 of FIG. 1. FIG. 3 illustrates a state in which the drain pan 6 in front of the ice chip dispenser is viewed from above. In FIG. 3, at the bottom 6*a* of the drain pan 6, there is provided a drain hole 9 communicating with the external drain system 3. The wash water discharge opening 7 is provided in the sidewall 6*b* that is situated at the rear of the drain pan 6 and extends along a width direction 6*w* thereof. Further, the wash water discharge opening 7 is positioned at the opposite side of the drain hole 9 in the width direction 6*w* of the drain pan 6. Specifically, when the drain pan 6 is viewed from the front of the dispenser as in FIG. 3, if the drain hole 9 is disposed on the right-hand side, the wash water discharge opening 7 is disposed on the left-hand side. With this configuration, the wash water does not flow directly into the drain hole 9, but flows into the drain hole 9 after washing a wider area of the bottom 6*a*.

Figure 4:
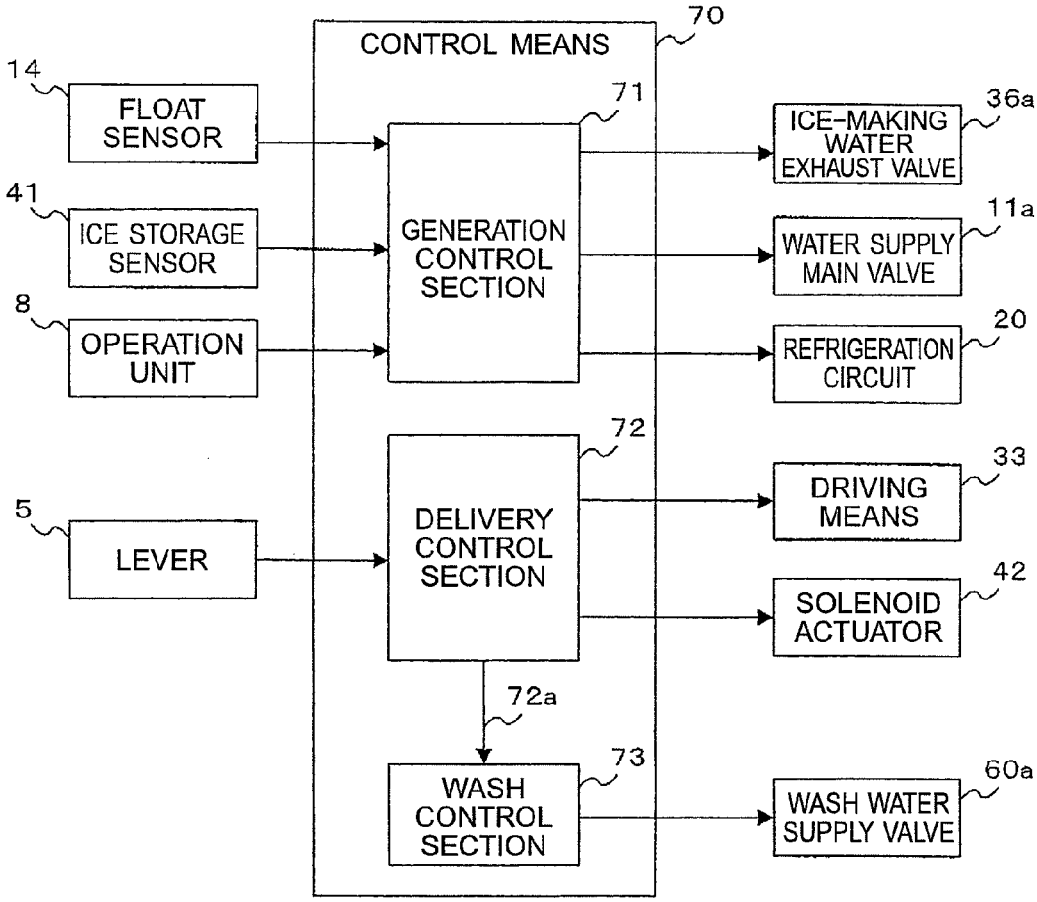
FIG. 4 is a block diagram illustrating control means of FIG. 1.

Next, FIG. 4 is a block diagram illustrating the control means 70 of FIG. 1. In FIG. 4, the control means 70 includes a generation control section 71 for controlling the generation of ice chips, delivery control section 72 for controlling the delivery of ice chips, and a wash control section 73 for performing a wash action.

When it is detected, by the float sensor 14, that the water level of the ice-making water stored in the ice-making water tank 10 has not reached the lower-limit water level, the generation control section 71 closes the ice-making water exhaust valve 36*a*, and also opens the water supply main valve 11*a*, to thereby supply the ice-making water to the ice-making water tank 10 and the refrigeration casing 31. Therefore, supplying of the ice-making water to the ice-making water tank 10 is performed when the water level of the ice-making water stored in the ice-making water tank 10 is lowered, that is, when ice chips are generated from the ice-making water. On the other hand, when it is detected, by the float sensor 14, that the water level of the ice-making water stored in the ice-making water tank 10 has reached the upper-limit water level, the generation control section 71 closes the water supply main valve 11*a*, to thereby stop supplying the ice-making water to the ice-making water tank 10 and the refrigeration casing 31.

Further, when it is detected, by the ice storage sensor 41, that the amount of ice chips stored in the ice storage chamber 40 has not reached the full ice capacity, the generation control section 71 activates the refrigeration circuit 20, and also activates the driving means 33 of the auger ice-making machine 30, to thereby cause the refrigeration circuit 20 and the auger ice-making machine 30 to carry out the action of generating ice chips. Further, when it is detected, by the ice storage sensor 41, that the amount of ice chips stored in the ice storage chamber 40 has reached the full ice capacity, the generation control section 71 stops driving the refrigeration circuit 20 and the driving means 33, to thereby stop the action of generating ice chips. Further, after the generation control section 71 stops the action of generating ice chips, the generation control section 71 starts to time, and drives the driving means 33 at predetermined time intervals, which causes the agitator 50 to carry out an agitation action for the ice chips.

Further, when a predetermined time duration has elapsed after start of supplying the ice-making water to the ice-making water tank 10 and the refrigeration casing 31 and when the operation unit 8 is operated, the generation control section 71 closes the water supply main valve 11*a*, and, at the same time, opens the ice-making water exhaust valve 36*a* to exhaust the ice-making water stored in the ice-making water tank 10 and the refrigeration casing 31 into the external drain system 3. This action is performed to prevent the impurity concentration of the ice-making water stored in the ice-making water tank 10 and the refrigeration casing 31 from becoming too high.

Further, when it is detected, by the electromagnetic switch of the lever 5, that the lever 5 is rotated, the delivery control section 72 displaces the shutter 44 by displacing upward the plunger 42*a* of the solenoid actuator 42, which causes the ice discharge opening of the ice storage chamber 40 to open. Further, the delivery control section 72 keeps, for a predetermined time duration, a state in which the plunger 42*a* is displaced upward, and then displaces the plunger 42*a* downward to cause the shutter 44 to close the ice discharge opening of the ice storage chamber 40.

The wash control section 73 is connected to the wash water supply valve 60*a*. By opening the wash water supply valve 60*a*, the wash control section 73 performs the wash action of supplying the wash water to the drain pan 6 through the wash water supply path 60 and the wash water discharge opening 7. In addition, the wash control section 73 judges whether or not the delivery count of ice chips has reached a predetermined set count based on delivery information 72*a* output from the delivery control section 72, and performs the wash action when it is judged that the delivery count has reached the set count. Here, the delivery information 72*a* is information indicating that the delivery of ice chips has been performed.

Figure 5:
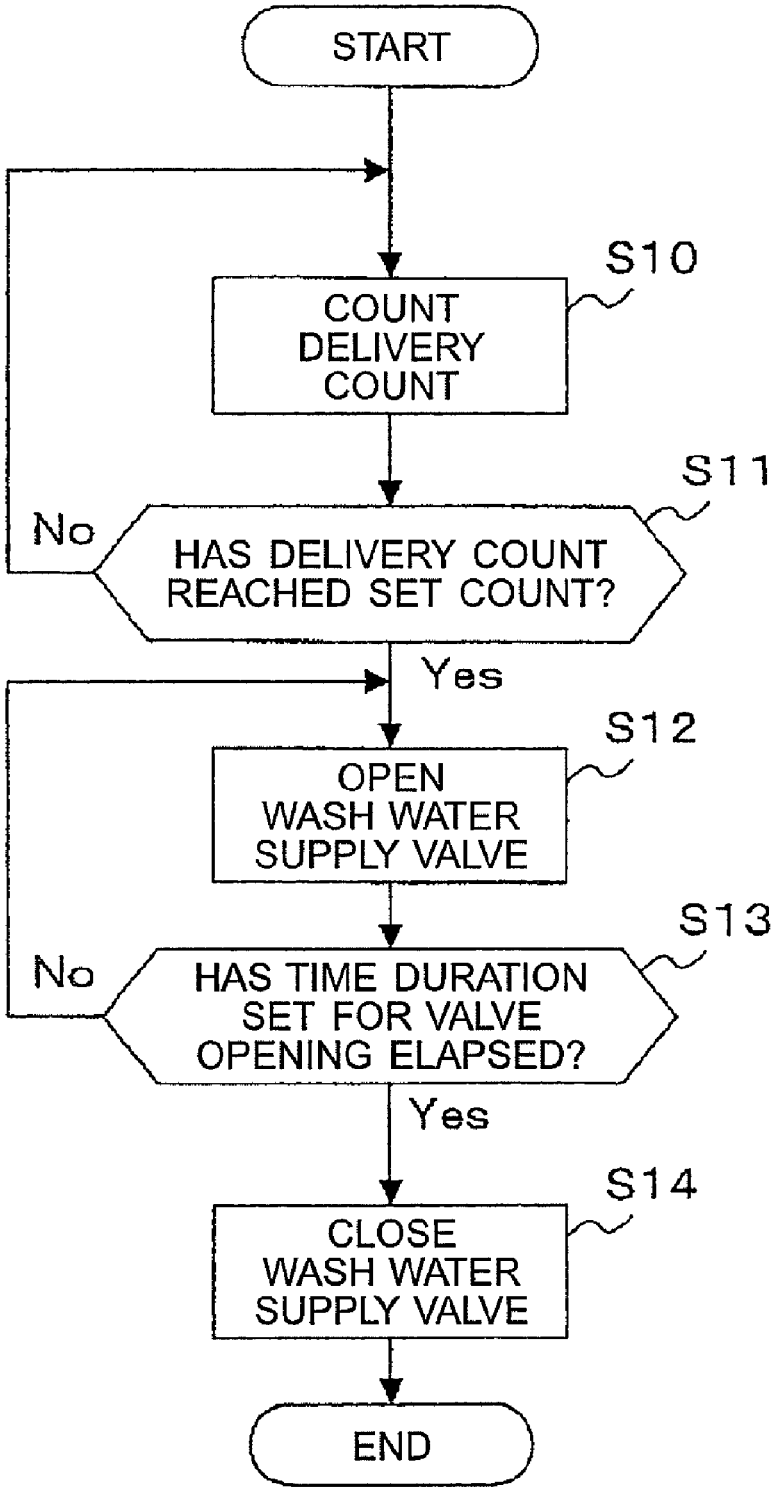
FIG. 5 is a flow chart illustrating an action of judging whether or not to carry out a wash action, which is performed by a wash control section of FIG. 4.

Next, FIG. 5 is a flow chart illustrating an action of judging whether or not to carry out the wash action, which is performed by the wash control section 73 of FIG. 4. In FIG. 5, after the entire ice chip dispenser is powered on, the counting of the delivery count is started in response to the power-on (Step S10). Specifically, judgment is repeatedly performed as to whether or not the delivery information 72*a* output from the delivery control section 72 is detected, and every time the delivery information 72*a* is detected, the delivery count is incremented by one.

Subsequently, it is judged whether or not the delivery count has reached the predetermined set count, such as ten (Step S11). When it is judged that the delivery count has not reached the set count, the counting of the delivery count is continued. On the other hand, when it is judged that the delivery count has reached the set count, the wash action is carried out (Steps S12 to S14). Specifically, the wash water supply valve 60*a* is opened to supply the wash water to the drain pan 6 (Step S12), and then, it is judged whether or not a predetermined time duration set for valve opening has elapsed (Step S13). When it is judged that the time duration set for valve opening has elapsed, the wash water supply valve 60*a* is closed (Step S14). It should be noted that the action of judging whether or not to carry out the wash action is repeatedly performed while the entire ice chip dispenser is in a powered-on state.

In such a dispenser, the wash control section 73 judges whether or not the delivery count of the ice chips has reached the predetermined set count based on the delivery information 72*a* output from the delivery control section 72. Then, when it is judged that the delivery count has reached the set count, the wash action is performed. As a result, it is possible to carry out the washing with a detailed response suitable to the usage of the dispenser. Specifically, it is possible to carry out the wash action with an appropriate frequency even in such an installation environment as follows: the ice-making action is not performed all day long even though the dispenser is used, and hence performing the wash action at the time of the ice-making action results in insufficient washing. As described above, the washing can be carried out with a response appropriate to the usage of the dispenser, which appropriately prevents dried juice and the like from adhering to the drain pan.

Second Embodiment

Figure 6:
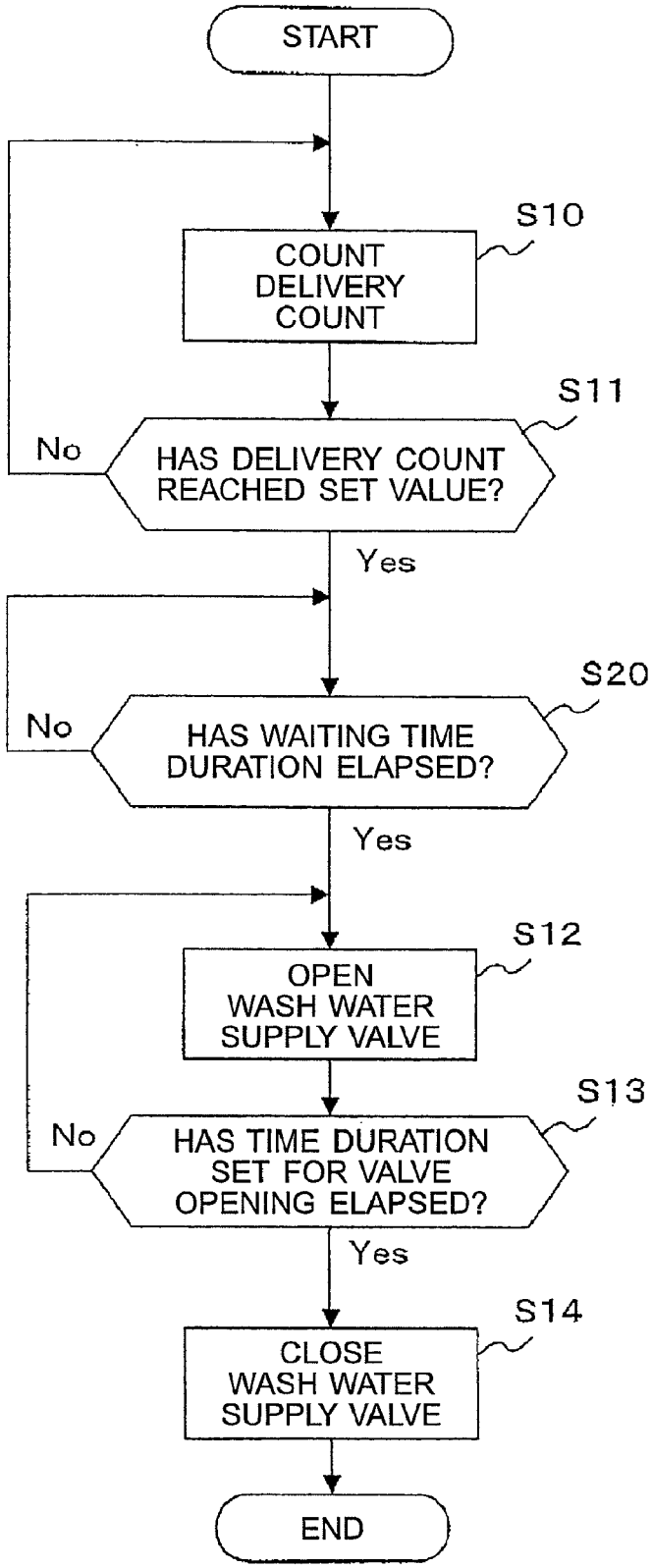
FIG. 6 is a flowchart illustrating an action of judging whether or not to carry out a wash action, which is performed by a wash control section of an ice chip dispenser according to a second embodiment of the present invention.

FIG. 6 is a flow chart illustrating an action of judging whether or not to carryout the wash action, which is performed by the wash control section 73 of an ice chip dispenser according to a second embodiment of the present invention. As for the configuration of the first embodiment, there is given the description in which the wash action is performed immediately after it is judged that the delivery count has reached the set count. However, according to the configuration of the second embodiment, the wash action is performed after a predetermined waiting time duration. This configuration is based on the assumption that juice and the like are not thrown away into the drain pan 6 immediately after the delivery of ice chips but are thrown away into the drain pan 6 when a user changes the content of his/her drink after a given time duration has elapsed after returning to his/her seat.

Specifically, as illustrated in FIG. 6, in judging whether or not the delivery count has reached the predetermined set count (Step S11), when it is judged that the delivery count has reached the set count, the wash control section 73 judges whether or not the predetermined waiting time duration has elapsed, for example, 30 minutes after the judgment that the delivery count has reached the set count (Step S20). Then, when it is judged, in this judgment, that the waiting time duration has elapsed, the wash action is carried out (Steps S12 to S14). The rest of the action is the same as in the first embodiment.

In such an ice chip dispenser, the wash control section 73 performs the wash action when the predetermined waiting time duration has elapsed after the judgment that the delivery count has reached the set count. Therefore, the wash action can be carried out at a timing at which juice and the like are supposed to be thrown away into the drain pan 6, which enables the wash action to be carried out more effectively.

Third Embodiment

Figure 7:
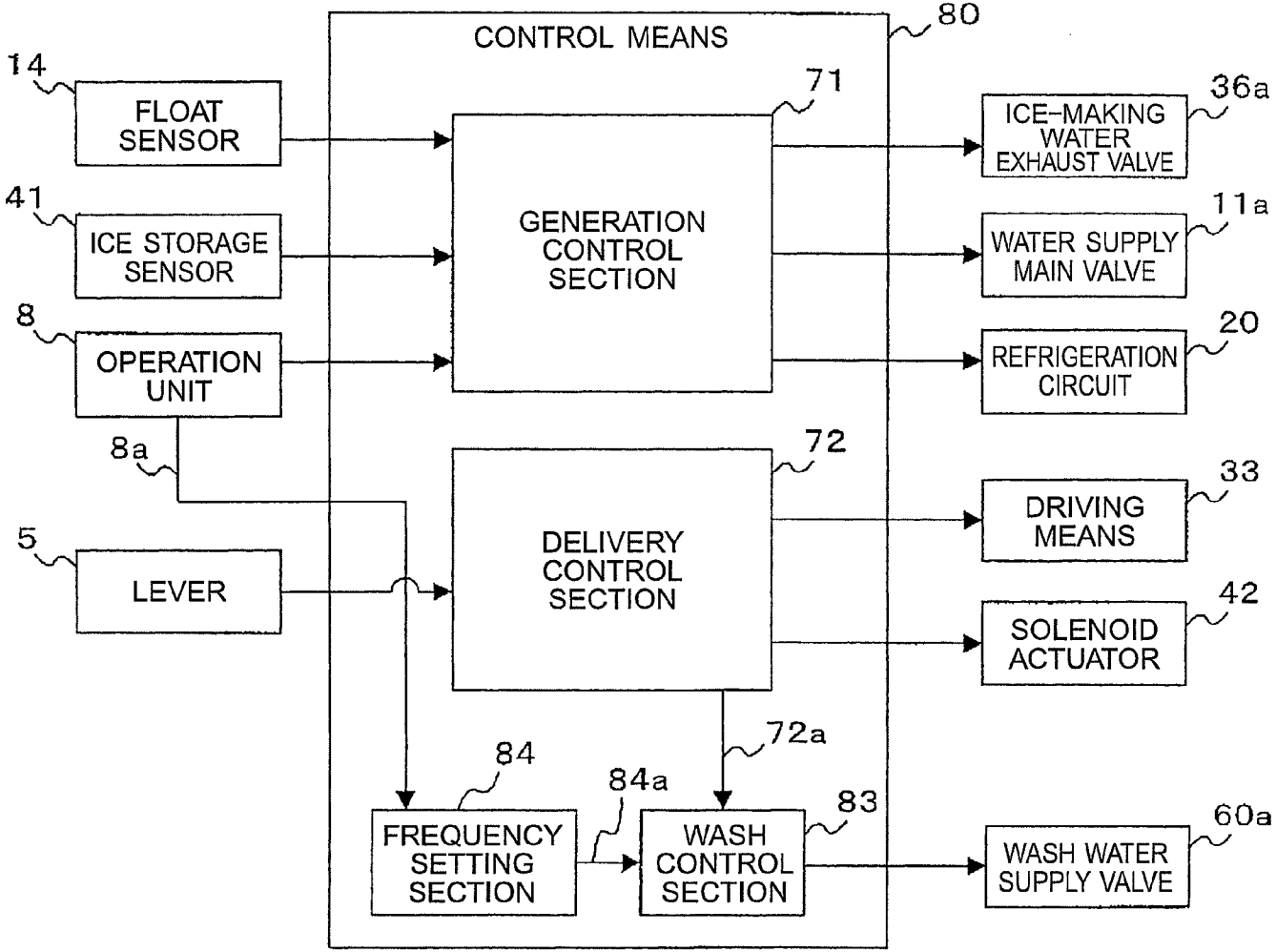
FIG. 7 is a block diagram illustrating control means of an ice chip dispenser according to a third embodiment of the present invention.

FIG. 7 is a block diagram illustrating control means 80 of an ice chip dispenser according to a third embodiment of the present invention. It should be noted that the same components as those of the first embodiment are denoted by the same reference numerals and symbols. In FIG. 7, compared to the control means 70 of the first embodiment, the control means 80 of the third embodiment is additionally provided with a frequency setting section 84. The frequency setting section 84 inputs frequency setting information 84 to a wash control section 83. Based on the frequency setting information 84*a*, the wash control section 83 increases or decreases the frequency of performing the wash action, that is, the set count used for judging whether or not to perform the wash action.

To the frequency setting section 84, a frequency changing signal 8*a* is input from the operation unit 8. The frequency changing signal 8*a* is a signal that is input in response to an operation performed on the operation unit 8 by the user. The frequency setting section 84 determines, based on the frequency changing signal 8*a* input from the operation unit 8, whether to output frequency setting information 84*a* for increasing the set count or to output frequency setting information 84*a* for decreasing the set count. Specifically, the ice chip dispenser of the third embodiment is so configured that the user can change the wash frequency arbitrarily. The rest of the configuration is the same as the configuration of the first embodiment.

Figure 8:
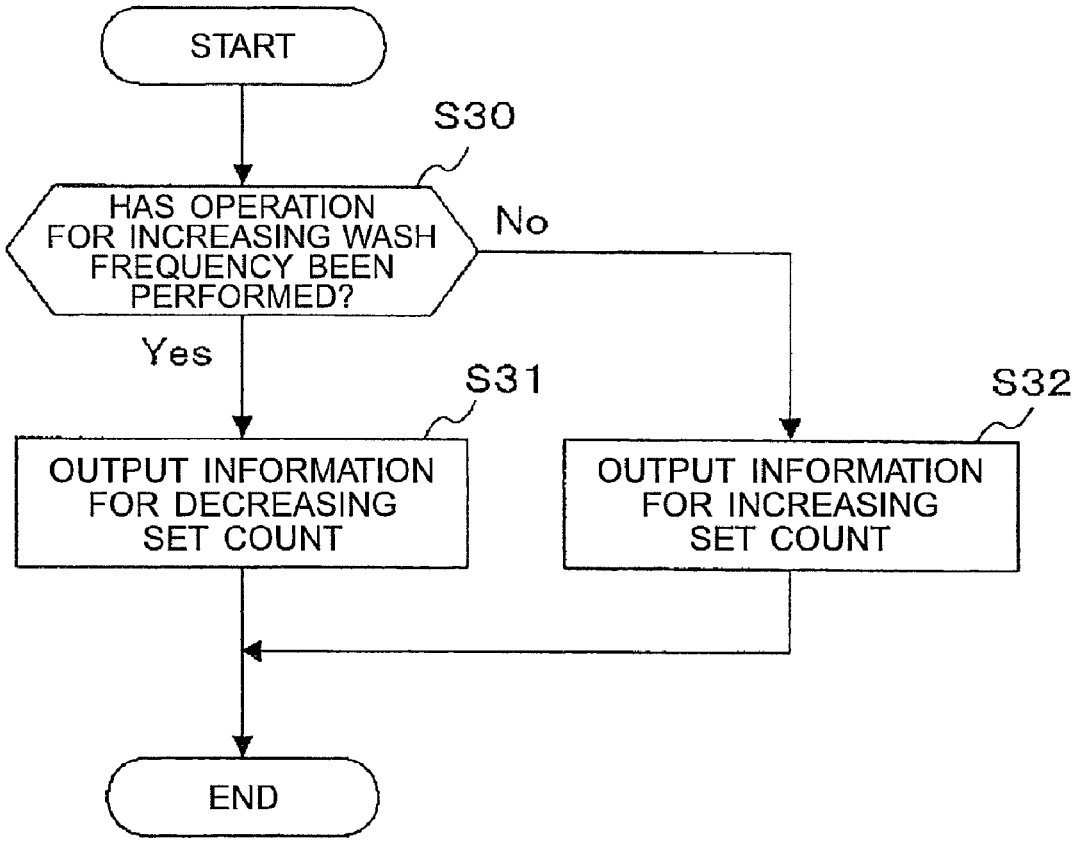
FIG. 8 is a flow chart illustrating an action of outputting frequency setting information, which is performed by a frequency setting section of FIG. 7.

Next, FIG. 8 is a flow chart illustrating an action of outputting the frequency setting information, which is performed by the frequency setting section 84 of FIG. 7. In FIG. 8, when the frequency changing signal 8*a* input from the operation unit 8 is detected, it is judged whether or not the user has performed an operation for increasing the wash frequency based on the frequency changing signal 8*a* (Step S30). On this occasion, when it is judged that the operation for increasing the wash frequency has been performed, the frequency setting information 84*a* for decreasing the set count is output (Step S31). On the other hand, when it is judged that an operation for decreasing the wash frequency has been performed, the frequency setting information 84*a* for increasing the set count is output (Step S32). The action of outputting the frequency setting information is repeated every time the frequency changing signal 8*a* is detected.

Figure 9:
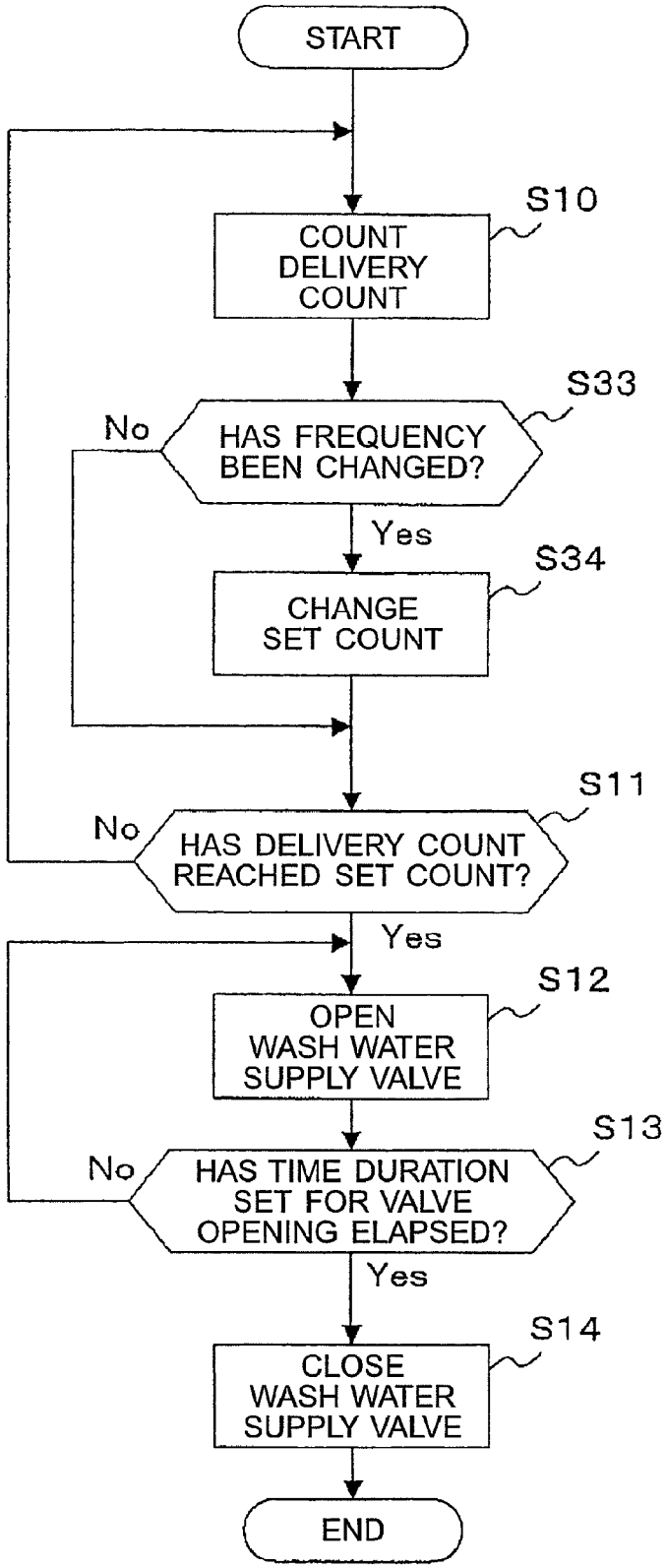
FIG. 9 is a flow chart illustrating an action of judging whether or not to carry out the wash action, which is performed by a wash control section of FIG. 7.

Next, FIG. 9 is a flow chart illustrating an action of judging whether to carry out the wash action, which is performed by the wash control section 83 of FIG. 7. In FIG. 9, after the entire ice chip dispenser is powered on, in response to the power-on, the counting of the delivery count is started (Step S10), and also, it is judged whether or not the wash frequency has been changed based on whether or not the frequency setting information 84*a* has been input (Step S33). On this occasion, when it is judged that the wash frequency has been changed based on the detection of the input of the frequency setting information 84*a*, the set count is increased or decreased based on the frequency setting information 84*a* (Step S34). The rest of the action is the same as in the first embodiment.

In such an ice chip dispenser, the wash control section 83 increases or decreases the set count based on the frequency setting information 84*a* output from the frequency setting section 84. Therefore, the wash action can be carried out with a frequency appropriate to the installation environment, which prevents the wash water from being wasted. Specifically, the cost on the tap water used for the ice chip dispenser can be reduced, therefore resulting in reduced maintenance cost.

Here, in the third embodiment, there is given the description in which the frequency setting section 84 outputs the frequency setting information 84*a* based on the frequency changing signal 8*a* input from the operation unit 8. However, the present invention is not limited thereto, and a frequency setting section may output frequency setting information based on the switching of switches or the like provided on a controller board, such as DIP switches, for example.

Further, in the first to third embodiments, there is given the description of the configuration of the ice chip dispenser. However, the present invention is not limited thereto, and may be applied to any dispenser that delivers a supply containing at least one of a drink and ice chips from the delivery opening. Specifically, the present invention may be applied to a drink dispenser having a configuration in which only drinks are delivered, or a drink dispenser having a configuration in which ice chips are delivered together with drinks.

Fourth Embodiment

Figure 10:
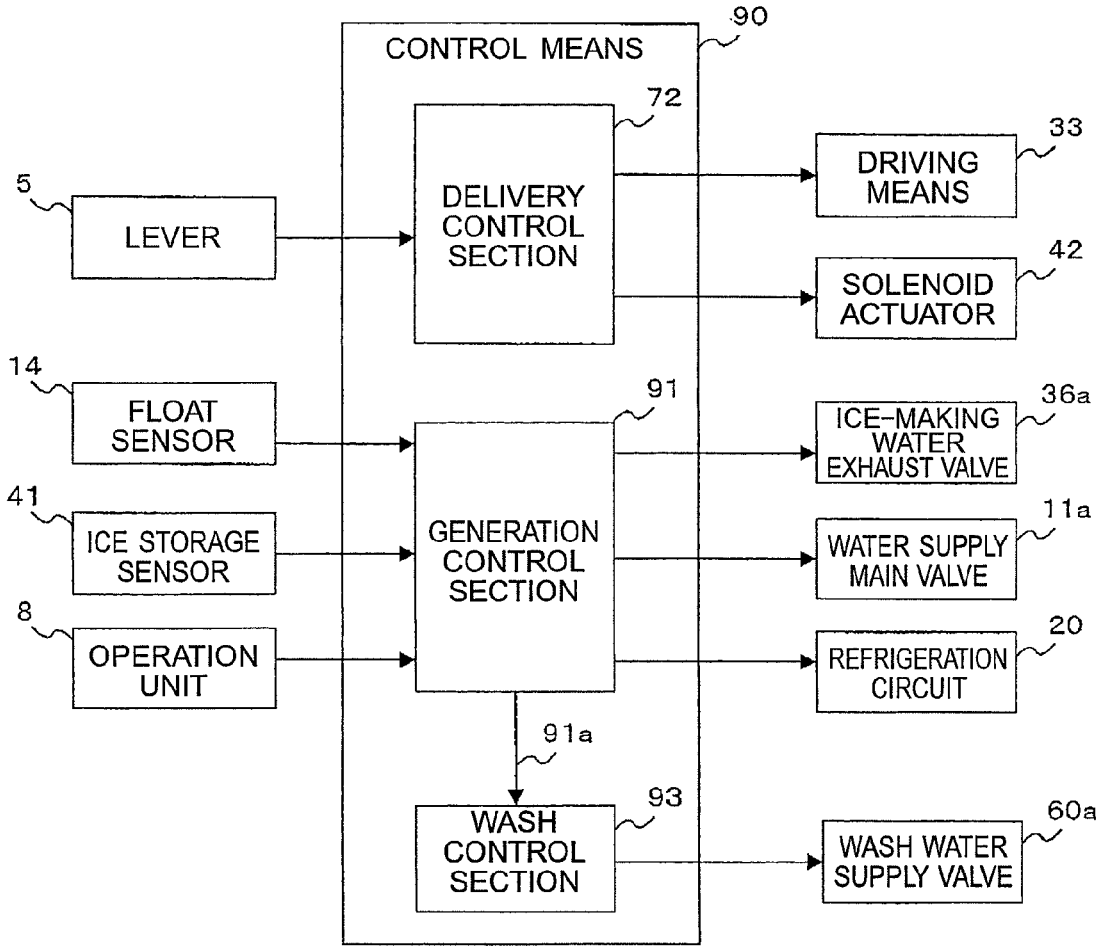
FIG. 10 is a block diagram illustrating control means of an ice chip dispenser according to a fourth embodiment of the present invention.

FIG. 10 is a block diagram illustrating control means 90 of an ice chip dispenser according to a fourth embodiment of the present invention. It should be noted that the same components as those of the first embodiment are denoted by the same reference numerals and symbols. In the first embodiment, there is given the description in which the wash control section 73 judges whether or not to carry out the wash action based on the delivery count of ice chips. However, awash control section 93 according to the fourth embodiment judges whether or not to carry out the wash action based on a count of water supplies to the ice-making water tank 10 (see FIG. 1).

As illustrated in FIG. 10, to the wash control section 93, water supply information 91*a* is input from a generation control section 91. The water supply information 91*a* is information indicating that the ice-making water has been supplied to the ice-making water tank 10 by opening the water supply main valve 11*a*. The wash control section 93 judges whether or not the count of water supplies to the ice-making water tank 10 has reached a predetermined set count based on the water supply information 91*a* output from the generation control section 91. When it is judged that the count of water supplies has reached the set count, the wash action is performed. The rest of the configuration is the same as in the first embodiment.

Figure 11:
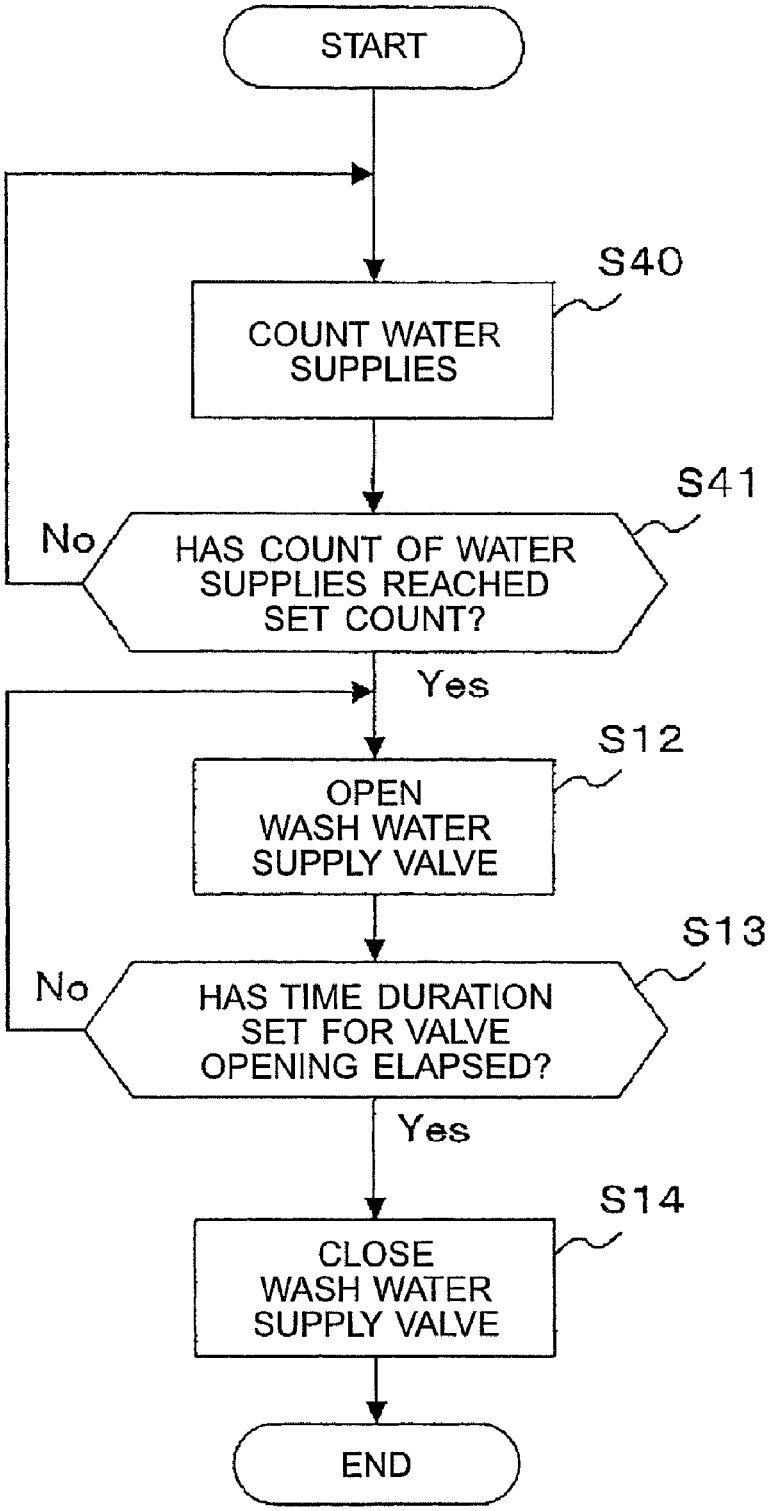
FIG. 11 is a flowchart illustrating an action of judging whether or not to carry out the wash action, which is performed by a wash control section 93 of FIG. 10.

Next, FIG. 11 is a flow chart illustrating an action of judging whether or not to carry out the wash action, which is performed by the wash control section 93 of FIG. 10. In FIG. 11, after the entire ice chip dispenser is powered on, in response to the power-on, the counting of water supplies is started (Step S40). Specifically, judgment is performed repeatedly as to whether or not the water supply information 91*a* output from the generation control section 91 is detected, and every time the water supply information 91*a* is detected, the count of water supplies is incremented by one.

Subsequently, it is judged whether or not the count of water supplies has reached the predetermined set count, such as five (Step S41), and when it is judged that the count of water supplies has not reached the set count, the counting of water supplies is continued. On the other hand, when it is judged that the count of water supplies has reached the set count, the wash action is carried out (Steps S12 to S14). The rest of the configuration is the same as in the first embodiment.

In such a dispenser, the wash control section 93 judges whether or not the count of water supplies to the ice-making water tank 10 has reached the predetermined set count based on the water supply information 91*a* output from the generation control section 91. Then, when it is judged that the count of water supplies has reached the set count, the wash action is performed. As a result, the washing can be carried out with a response appropriate to the usage of the dispenser. Specifically, in an installation environment in which the ice-making action is performed frequently owing to the fact that the dispenser is used frequently, there occurs a case in which the washing effect can be sufficiently obtained even if the wash action is carried out after the ice-making action is performed a plurality of times. In such a case, by employing the configuration of the fourth embodiment, it is possible to prevent the wash action from being carried out unnecessarily, thus resulting in the prevention of waste of the wash water.

Here, in the fourth embodiment, there is given the description in which the set count used for judging whether or not to carry out the wash action is fixed. However, similarly to the configuration of the third embodiment, a frequency setting section may be provided to increase or decrease the set count.

Further, in the fourth embodiment, there is given the description of the configuration of the ice chip dispenser. However, the present invention is not limited thereto, and the dispenser having the configuration in which the wash action is performed according to the count of water supplies to the ice-making water tank may be applied to any dispenser that delivers a supply containing at least ice chips from the delivery opening. Specifically, the dispenser having the configuration in which the wash action is performed according to the count of water supplies to the ice-making water tank may also be applied to a drink dispenser having a configuration in which ice chips are supplied together with drinks.

What is claimed is:

1. A dispenser that delivers a supply containing at least one of a drink and ice chips from a delivery opening, and that has a drain pan disposed below the delivery opening so that the supply is received, wherein the dispenser comprises:

a delivery control section for controlling delivery of the supply;

a wash water discharge opening provided to the drain pan;

a wash water supply path connected to the wash water discharge opening;

a wash water supply valve provided to the wash water supply path; and a wash control section connected to the wash water supply valve, for performing, by opening the wash water supply valve, a wash action of supplying wash water to the drain pan through the wash water supply path and the wash water discharge opening, and wherein the wash control section judges, based on information from the delivery control section, whether or not a delivery count of the supply has reached a predetermined set count, and, when it is judged that the delivery count has reached the predetermined set count, performs the wash action.

2. A dispenser according to claim 1, wherein the wash control section performs the wash action when a predetermined waiting time duration elapses after it is judged that the delivery count has reached the predetermined set count.

3. A dispenser according to claim 1, wherein the dispenser further comprises a frequency setting section connected to the wash control section, for inputting frequency setting information to the wash control section, and wherein the wash control section increases and decreases the predetermined set count based on the frequency setting information from the frequency setting section.

4. A dispenser that delivers a supply containing at least ice chips from a delivery opening, and that has a drain pan disposed below the delivery opening so that the supply is received, wherein the dispenser comprises:

a generation control section for controlling generation of the ice chips;

a water supply main valve connected to the generation control section, for performing, in response to the controlling from the generation control section, switching as to whether or not to supply an ice-making water tank with ice-making water to be used for the generation of the ice chips;

a wash water discharge opening provided to the drain pan;

a wash water supply path connected to the wash water discharge opening;

a wash water supply valve provided to the wash water supply path; and a wash control section connected to the wash water supply valve, for performing, by opening the wash water supply valve, a wash action of supplying wash water to the drain pan through the wash water supply path and the wash water discharge opening, and wherein the wash control section judges, based on information from the generation control section, whether or not a count of water supplies to the ice-making water tank has reached a predetermined set count, and, when it is judged that the count of the water supplies has reached the predetermined set count, performs the wash action.

5. A dispenser according to claim to 4, wherein the dispenser further comprises a frequency setting section connected to the wash control section, for inputting frequency setting information to the wash control section, and wherein the wash control section increases and decreases the predetermined set count based on the frequency setting information from the frequency setting section.

* * * * *